US007044679B2

(12) United States Patent
Groff

(10) Patent No.: US 7,044,679 B2
(45) Date of Patent: May 16, 2006

(54) OPTICAL ILLUSION SPEED BUMP AND METHOD OF USING THE SAME

(76) Inventor: Bradley K. Groff, 613 Candler St., Decatur, GA (US) 30030

( * ) Notice: Subject to any disclaimer, the term of this patent is extended or adjusted under 35 U.S.C. 154(b) by 686 days.

(21) Appl. No.: 09/859,179

(22) Filed: May 16, 2001

(65) Prior Publication Data

US 2002/0172553 A1 Nov. 21, 2002

(51) Int. Cl.
*G08B 5/00* (2006.01)

(52) U.S. Cl. ..... 404/16; 404/15

(58) Field of Classification Search ..... 404/15, 404/16; 362/153.1

See application file for complete search history.

(56) References Cited

U.S. PATENT DOCUMENTS

| | | | | |
|---|---|---|---|---|
| 3,954,346 A | * | 5/1976 | Miller | 404/16 |
| 4,983,458 A | * | 1/1991 | Dejaiffe | 404/94 X |
| 5,267,808 A | | 12/1993 | Welford | |
| 5,695,346 A | * | 12/1997 | Sekiguchi et al. | 434/365 |
| 5,775,834 A | * | 7/1998 | Jackson | 404/15 |
| D425,627 S | * | 5/2000 | Harwood et al. | D25/102 |
| 6,174,103 B1 | | 1/2001 | Stroman | |

FOREIGN PATENT DOCUMENTS

| | | | |
|---|---|---|---|
| FR | 2575856 | * | 7/1986 |
| GB | 2227269 | * | 7/1990 |
| GB | 2315794 | * | 2/1998 |

OTHER PUBLICATIONS

Internet article, "Painted patterns for slowing traffic" ; Nov. 1996; (1 page).*
Internet article, "Safer Highways"; 1998; (1 page).*
Internet article "Asphalt Contractors Bring Beauty to Their Paving Projects"; Dec. 1999; (8 pages).*
Internet article, "Evaluation of Work Zone Speed Reduction Measures"; Apr. 2000; (3 pages).*
Eyetricks Image Gallery #1-Optical illusions from eyetricks.com; May 16, 2001; 2 pgs.

* cited by examiner

*Primary Examiner*—Sunil Singh
(74) *Attorney, Agent, or Firm*—Gardner Groff Santos & Greenwald, PC

(57) ABSTRACT

A speed control method and device. A speed bump is optically simulated on a roadway as by painting the roadway to create the appearance of a real speed bump, or an actual speed bump is visually enhanced to appear larger than it actually is. Actual speed bumps can be randomly interspersed among simulated speed bumps along a roadway.

17 Claims, 1 Drawing Sheet

OPTICAL ILLUSION SPEED BUMP AND METHOD OF USING THE SAME

FIELD OF THE INVENTION

The present invention relates generally to traffic control methods and devices; and more particularly to a speed bump that is optically enhanced or simulated.

BACKGROUND OF THE INVENTION

Description of Related Art

Speed control devices such as speed bumps or road humps are utilized to discourage speeding in residential neighborhoods. These speed control devices, however, negatively affect even those drivers who are obeying the speed limit yet still must tolerate the discomfort or annoyance caused by bouncing over the speed bump. Repeated travel over speed bumps may also damage a vehicle's suspension or cause accelerated wear of vehicle components. Also, increased traffic noise is often generated as vehicles impact a speed bump, and as vehicles decelerate before a speed bump and accelerate after a speed bump.

Residents generally do not speed dangerously through their own neighborhood. Rather, the worst offenders of the speed limit laws are often non-residents cutting through a neighborhood, or visitors to the neighborhood. These speeding non-residents are all the more dangerous, as they typically do not know the roadways, traffic patterns or surroundings of a neighborhood as well as do the neighborhood's residents. For example, a non-resident is less likely than a resident to know that neighborhood children play in certain areas along the roadways, increasing the need for driver caution in these areas.

Thus it can be seen that needs exist for a manner of controlling vehicle speed that causes less inconvenience and annoyance for those persons who are most likely to obey posted speed limits, and that is most effective against speeding by those who are least familiar with the road and surrounding neighborhood. It is to a speed control method and device meeting these and other needs that the present invention is primarily directed.

SUMMARY OF THE INVENTION

The present invention provides an improved method and device for vehicle speed control. The present invention takes advantage of non-resident drivers' unfamiliarity with neighborhood roadways, without subjecting residents and those familiar with the roadways to undue inconvenience and annoyance. The method and device of the present invention utilize a visually enhanced speed bump or a visually created simulated speed bump (i.e., an optical illusion) to control vehicle speed. Those unfamiliar with the roadway will not know that an upcoming speed bump is visually enhanced or optically simulated, and will slow down as if they were approaching a normal speed bump. Those familiar with a neighborhood will come to know which speed bumps are real and which are optically simulated or enhanced, and will be less inconvenienced thereby.

In one aspect, the present invention is a speed control device preferably comprising a portion of a roadway having at least one visually perceptible feature applied thereon, the at least one visually perceptible feature simulating the appearance of a speed bump to oncoming traffic.

In another aspect, the present invention is a speed control device preferably comprising a generally flat portion of a roadway; an elevated bump projecting a first height above the generally flat portion of a roadway; and at least one visually perceptible feature applied on or adjacent the elevated bump to present the appearance of a speed bump having a second height greater than the first height.

In still another aspect, the present invention is a method of controlling vehicle speed along a roadway, the method preferably comprising providing a plurality of speed control devices at spaced apart locations along a roadway, wherein at least one of the speed control devices comprises at least one visually perceptible feature applied to the roadway, the visually perceptible feature simulating the appearance of a speed bump to oncoming traffic.

These and other objects, features and advantages of preferred forms of the present invention are described in greater detail herein with reference to preferred and example embodiments.

DETAILED DESCRIPTION

Figure 1:
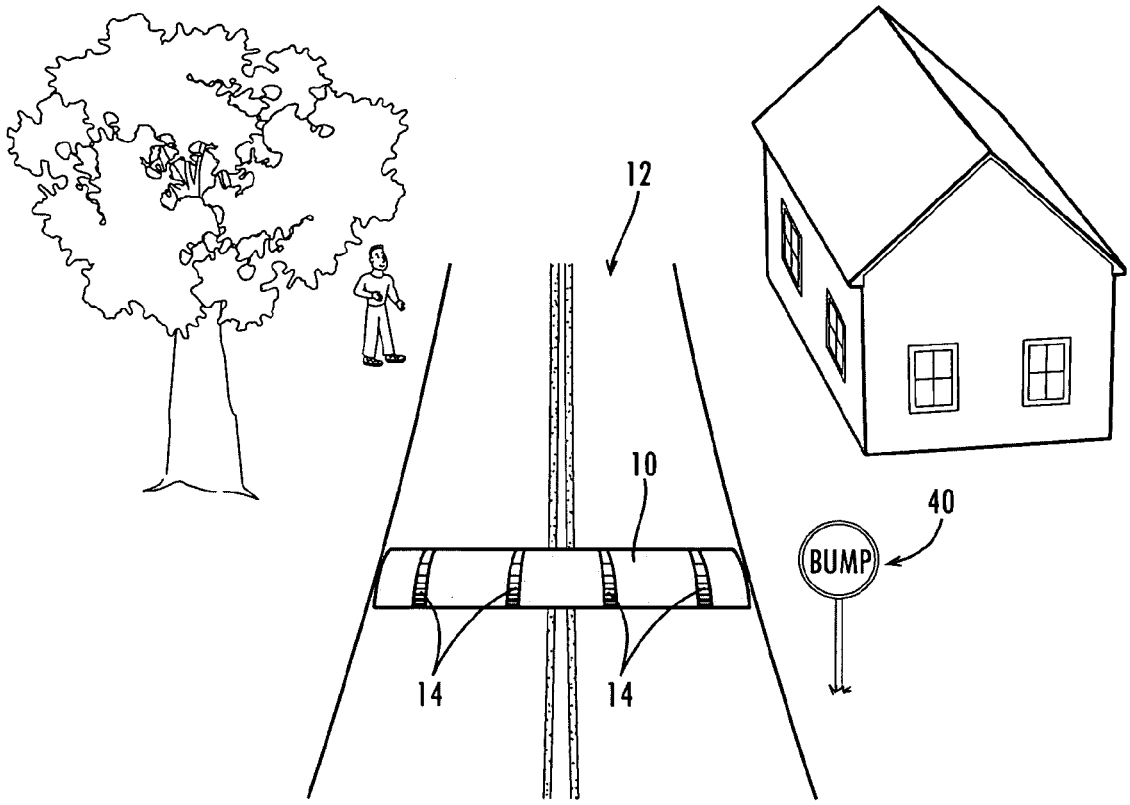
FIG. 1 is a perspective view of a speed control device according to a preferred form of the present invention.
Figure 2:
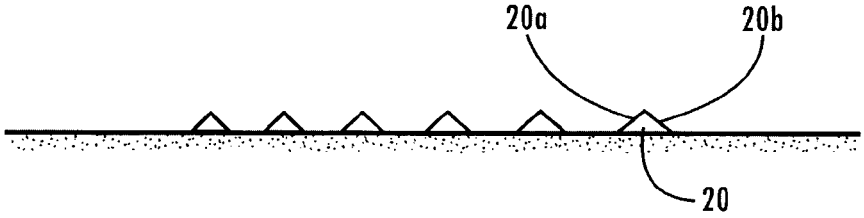
FIG. 2 is a side cross-sectional view of a speed control device according to one preferred form of the present invention.

Referring now to the drawing figures, wherein like reference numerals represent like parts throughout, preferred forms of the present invention will now be described. As seen best with reference to FIGS. 1–3, one form of the invention is a simulated or optically enhanced speed bump 10 provided on a roadway 12.

The simulated or optically enhanced speed bump 10 preferably comprises at least one visually perceptible feature 14 applied on a portion of the roadway, whereby the at least one visually perceptible feature simulates the appearance of a speed bump to oncoming traffic, or enhances the appearance of an actual speed bump of the roadway. The visually perceptible feature 14 can take a number of forms, such as for example: a portion of the roadway painted to create the optical illusion of a speed bump in the roadway where none actually exists; a painted or printed image applied to an actual speed bump to create the illusion of a speed bump of greater size or steeper impact surface; a decal or printed panel applied to the roadway to simulate or optically enhance an actual speed bump; and/or a laser-generated holographic image simulating or enhancing an actual speed bump. In an example embodiment, the visually perceptible feature(s) 14 is/are printed or otherwise applied on the top surface of a rubber or plastic mat that is placed across the roadway to create the optical illusion of a speed bump. The simulation or enhancement of an actual speed bump can be effected by appropriate selection of the coloring, shading, placement and geometric shapes and sizes of elements of the visually perceptible features 14, much in the manner of commonly known optical illusions (see, http://www.eyetricks.com).

In one embodiment of the invention, the one or more visually perceptible features 14 are applied to a generally flat portion of a roadway, and the entire speed control device is optically simulated (i.e., there is no real speed bump). In another embodiment, the one or more visually perceptible features 14 are applied to a portion of the road comprising an elevated portion 16 having a first height, such as a relatively small actual speed bump, and the visually perceptible features optically enhance the bump to create the appearance of a larger speed bump having a second height greater than the first height or a speed bump having a more steeply inclined impact surface (i.e., a nastier speed bump). In still another embodiment, the one or more visually perceptible features 14 are applied to an irregular roadway surface, such as a "rumble strip", which generates some sound and vibration as the vehicle passes over.

The simulated or optically enhanced speed bump 10 preferably presents the appearance of a speed bump (or a nastier speed bump) to oncoming traffic approaching from a first direction along the roadway 12. More preferably, the simulated or optically enhanced speed bump 10 presents the appearance of a speed bump (or a nastier speed bump) to oncoming traffic approaching from a first direction along the roadway 12 and also from a second direction opposite the first direction. This "two-way" simulation or enhancement is preferably effected by applying the visually perceptible features 14 to opposite first and second faces 20*a*, 20*b* on either side of one or more ridges 20 formed in or on the roadway 12, as seen with reference to FIG. 2. In this manner, traffic approaching the speed bump 10 from a direction facing faces 20*a* will observe the one or more visually perceptible features 14 applied to faces 20*a*, and traffic approaching the speed bump 10 from a direction facing faces 20*b* will observe the one or more visually perceptible features 14 applied to faces 20*b*. Alternatively, two way simulation or enhancement is effected by applying visually perceptible features 14 to first faces of one or more ridges 20 facing in opposed directions, as seen with reference to FIG. 3.

Figure 3:
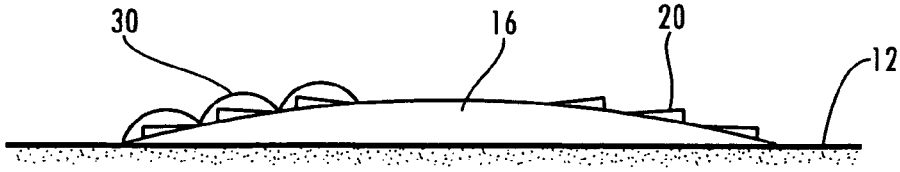
FIG. 3 is a side cross-sectional view of a speed control device according to another preferred form of the present invention.

In a further preferred and optional embodiment, and with particular reference to FIG. 3, a lenticular surface 30 is applied over the one or more visually perceptible features 14 to enhance the image produced thereby. For example, a generally transparent polymeric surface coating comprising hemi-cylindrical or otherwise curved external surfaces are applied over ridges 20 bearing the one or more visually perceptible features 14, functioning as optical lenses to magnify or otherwise enhance the viewed image of the visually perceptible features.

The invention further comprises a method of controlling vehicle speed along a roadway. The method preferably comprises providing a plurality of speed control devices at spaced apart locations along a roadway. For example, a series of speed control devices can be placed along a roadway, with each speed control device spaced approximately 100 feet from an adjacent speed control device. At least one of the speed control devices in the series of devices is a simulated or optically enhanced speed control device 10, substantially as described above, comprising at least one visually perceptible feature applied to the roadway. More preferably, the series of devices also includes at least one actual speed bump(s). The actual speed bump(s) and simulated/enhanced speed bumps are preferably intermixed with one another in a random distribution, whereby unfamiliar drivers will not know which are real and therefore will slow down for all of them. The simulated/enhanced speed bumps are most preferably configured to create a similar appearance to that of the real speed bumps. A "bump" sign or other indicator means 40 can be placed on or adjacent the simulated/enhanced speed bump(s) to further enhance the illusion of a real speed bump.

The above description and appended drawings are representative of example embodiments of the present invention. The full spirit and scope of the invention, however, is not limited to any particular embodiment or embodiments. Thus, it will be readily apparent to those of ordinary skill in the art that many additions, modifications and deletions can be made to the described embodiments without departing from the spirit and scope of the invention.

What is claimed is:

1. A speed control device comprising a portion of a roadway having at least one visually perceptible feature applied thereon, said at least one visually perceptible feature simulating the appearance of a speed bump to oncoming traffic.

2. The speed control device of claim 1, wherein the portion of the roadway comprises an elevated portion having a first height, and wherein the at least one visually perceptible feature applied thereon simulates the appearance of a speed bump having a second height greater than the first height.

3. The speed control device of claim 1, wherein the portion of the roadway comprises an irregular surface.

4. The speed control device of claim 1, wherein said at least one visually perceptible feature simulates the appearance of a speed bump to oncoming traffic approaching from a first direction.

5. The speed control device of claim 4, wherein said at least one visually perceptible feature also simulates the appearance of a speed bump to oncoming traffic approaching from a second direction opposite said first direction.

6. The speed control device of claim 1, wherein the portion of the roadway comprises a ridged surface having a plurality of ridges extending generally perpendicularly across said roadway, and wherein the at least one visually perceptible feature is applied to said ridges.

7. The speed control device of claim 1, wherein the at least one visually perceptible feature comprises an image-enhancing lenticular surface applied thereon.

8. A speed control device comprising:

a generally flat portion of a roadway;

an elevated bump projecting a first height above the generally flat portion of a roadway; and at least one visually perceptible feature applied on or adjacent the elevated bump to present the appearance of a speed bump having a second height greater than the first height.

9. The speed control device of claim 8, wherein the at least one visually perceptible feature presents the appearance of a speed bump having a second height greater than the first height to oncoming traffic approaching from a first direction.

10. The speed control device of claim 9, wherein said at least one visually perceptible feature also presents the appearance of a speed bump having a second height greater than the first height to oncoming traffic approaching from a second direction opposite said first direction.

11. The speed control device of claim 8, wherein the at least one visually perceptible feature is applied to a plurality of ridges extending on or adjacent the elevated bump in a direction generally perpendicular to a travel direction along said roadway.

12. The speed control device of claim 8, wherein the at least one visually perceptible feature comprises an image-enhancing lenticular surface applied thereon.

13. A method of controlling vehicle speed along a roadway, comprising providing a plurality of speed control devices at spaced apart locations along a roadway, wherein at least one of said speed control devices comprises at least one visually perceptible feature applied to the roadway, said visually perceptible feature simulating the appearance of a speed bump to oncoming traffic.

14. The method of claim 13, wherein the roadway comprises an actual elevated bump having a first height, and wherein the at least one visually perceptible feature provides the elevated bump with the appearance of a speed bump having a second height greater than the first height.

15. The method of claim 13, wherein at least one of said speed control devices comprise an actual speed bump.

16. The method of claim 15, wherein the plurality of speed control devices comprise a mix of actual speed bumps and simulated speed bumps.

17. The method of claim 16, wherein the actual speed bumps are randomly distributed among the plurality of speed control devices.

* * * * *